US010041274B2

(12) United States Patent
Lai

(10) Patent No.: US 10,041,274 B2
(45) Date of Patent: Aug. 7, 2018

(54) MECHANICAL COMPOSITE LOCK

(71) Applicant: YIFENG MANUFACTURING CO., LTD., Dongguan (CN)

(72) Inventor: Leo Lai, Dongguan (CN)

(73) Assignee: YIFENG MANUFACTURING CO., LTD., Dongguan, Guangdong (CN)

( * ) Notice: Subject to any disclaimer, the term of this patent is extended or adjusted under 35 U.S.C. 154(b) by 258 days.

(21) Appl. No.: 14/914,862

(22) PCT Filed: Apr. 19, 2015

(86) PCT No.: PCT/CN2015/076929
§ 371 (c)(1),
(2) Date: Feb. 26, 2016

(87) PCT Pub. No.: WO2015/165337
PCT Pub. Date: Nov. 5, 2015

(65) Prior Publication Data

US 2016/0215523 A1 Jul. 28, 2016

(30) Foreign Application Priority Data

Apr. 30, 2014 (CN) ..... 2014 1 0179873

(51) Int. Cl.
*E05B 37/00* (2006.01)
*E05B 35/10* (2006.01)
*E05B 65/52* (2006.01)

(52) U.S. Cl.
CPC ..... *E05B 37/0034* (2013.01); *E05B 35/105* (2013.01); *E05B 37/0058* (2013.01); *E05B 65/52* (2013.01)

(58) Field of Classification Search
CPC ..... E05B 37/0034; E05B 35/105; E05B 37/0058; E05B 65/52; E05B 37/0031;
(Continued)

(56) References Cited

U.S. PATENT DOCUMENTS 2,267,374 A * 12/1941 Eber ..... E05B 37/02 70/312
5,927,110 A * 7/1999 Yu ..... A44B 19/301 70/312
(Continued)

FOREIGN PATENT DOCUMENTS

CN 103953229 A 7/2014
CN 203924949 U 11/2014

*Primary Examiner* — Suzanne Lale Dino Barrett
(74) *Attorney, Agent, or Firm* — Ming Chew; Sinorica, LLC

(57) ABSTRACT

A mechanical composite lock includes a bottom plate and an upper shell, wherein an accommodation space is formed between the bottom plate and the upper shell; the accommodation space is provided with two groups of locking hooks; an inserting hole is formed in the upper shell; two moving pieces are arranged in the accommodation space; the opening directions of the two groups of locking hooks are opposite to each other; a middle transmission mechanism, a lock cylinder device and a password device are arranged in the accommodation space; the middle transmission mechanism is connected with the moving pieces respectively; the accommodation space is provided with a moving space; the lock cylinder device and the password device are respectively connected with the middle transmission mechanism; the lock can be opened at one time through the lock cylinder device and can also be sequentially opened through the password device.

10 Claims, 10 Drawing Sheets

(58) Field of Classification Search
CPC .. E05B 37/0041; E05B 37/0048; E05B 37/02; E05B 37/08; E05B 65/5207; E05B 65/5215; E05B 65/5223; E05B 65/5246; E05B 65/5253; E05B 65/5261; E05B 65/5269; E05B 65/5284
USPC ..... 70/21, 284, 285
See application file for complete search history.

(56) References Cited

U.S. PATENT DOCUMENTS 6,065,313 A * 5/2000 Huang ..... A44B 19/301 70/316
6,807,832 B1 * 10/2004 Jeng ..... E05B 37/12 190/101
7,290,417 B1 * 11/2007 Huang ..... E05B 37/02 70/285
8,096,150 B2 * 1/2012 Lai ..... A44B 19/301 70/21
8,161,778 B1 * 4/2012 Ma ..... E05B 35/007 70/21
8,661,861 B2 * 3/2014 Lai ..... E05B 37/12 70/21
9,745,780 B2 * 8/2017 Chen ..... E05B 65/48
9,809,998 B2 * 11/2017 Lai ..... E05B 65/52
9,845,616 B2 * 12/2017 Lai ..... E05B 37/0031
2006/0254329 A1 * 11/2006 Yu ..... E05B 37/02 70/284
2007/0193316 A1 * 8/2007 Huang ..... E05B 37/02 70/284
2008/0173050 A1 * 7/2008 Cheng ..... E05B 37/0034 70/284
2013/0067971 A1 * 3/2013 Huang ..... E05B 65/52 70/286
2013/0091906 A1 * 4/2013 Chen ..... E05B 65/52 70/68
2015/0014109 A1 * 1/2015 Lai ..... A45C 5/14 190/111
2015/0040622 A1 * 2/2015 Meersschaert ..... E05B 35/105 70/69
2015/0330104 A1 * 11/2015 Lai ..... E05B 335/105 70/285
2016/0215523 A1 * 7/2016 Lai ..... E05B 37/0034
2016/0290014 A1 * 10/2016 Lai ..... E05B 37/0031
2017/0074002 A1 * 3/2017 Cooper ..... E05B 35/105

* cited by examiner

MECHANICAL COMPOSITE LOCK

FIELD OF THE INVENTION

The present invention belongs to the technical field of locks, and more particularly, relates to a mechanical composite lock.

BACKGROUND OF THE INVENTION

With the development of society, the number of people travel become more and more frequent; people usually carry luggage in traveling, in order to carry more goods, luggage is provided with a number of sandwiches, which are sealed by zippers; there are many kinds of locks in the market for better management of the zippers, in order to control the sandwiches conveniently, the locks are provided with multiple groups of control holes; for example, in the applicant's prior utility model patent Mechanical Lock, whose patent number is CN201320494545.3; the left and right locking hooks can be opened respectively through the leftward and rightward movement of a motion block, which achieves respective management. When it is in need of opening all the sandwiches, the pushing part must be slid leftward and rightward respectively, which is not conducive to transit checking, reducing the efficiency of transit checking. If all the sandwiches are opened in one time, for example, in the applicant's prior utility model patent Double Locking Hooks Coded Lock, whose patent number is CN201320508516.8; however, the double locking hooks coded lock can not control the sandwiches respectively, when it is in need of opening some sandwich, all the zippers of the sandwiches must be unlocked, which is inconvenient for use.

SUMMARY OF THE INVENTION

The present invention is to overcome the foresaid disadvantages in prior art that the parts of the lock can not be controlled uniformly or be controlled respectively, which is inconvenient for use; the present invention provides a mechanical composite lock, which can be controlled uniformly and be controlled respectively, so it is convenient for use.

The solution of the present invention is as follows:

A mechanical composite lock which includes a bottom plate and an upper shell, wherein the both are connected with each other fixedly and an accommodation space is formed between them; the accommodation space is provided with two groups of locking hooks at one end; an inserting hole matching with a locking hook is formed in the upper shell; two moving pieces for controlling the two groups of locking hooks are arranged in the accommodation space as first moving piece and second moving piece; the opening directions of the two groups of locking hooks are opposite to each other; the accommodation space is provided with a middle transmission mechanism, a lock cylinder device and a password device at the other end, the middle transmission mechanism is connected with the first moving piece and the second moving piece respectively; the accommodation space is provided with a moving space for moving the middle transmission mechanism; the lock cylinder device and the password device are respectively connected with the middle transmission mechanism; when the lock is opened through a password, the middle transmission mechanism can move relative to the accommodation space and drive the first moving piece and second moving piece to move in the same direction, and then one group of locking hooks are opened; when the lock is opened through the lock cylinder device, the first moving piece and second moving piece are driven to move in opposite directions, and then the two groups of locking hooks are opened.

Furthermore, the middle transmission mechanism includes a rotating block, the rotating block is provided with two connecting portions, which are respectively connected with the two moving pieces; the rotating block is connected with the lock cylinder device, wherein the lock cylinder device can drive the rotating block to rotate.

Furthermore, the password device is provided with a switching member for controlling the movement of the middle transmission mechanism, when the lock is locked through a password, the switching member is located in locking position limiting the movement of the middle transmission mechanism; when the lock is opened through a password, the switching member is located in unlocking position permitting the movement of the middle transmission.

Furthermore, the password device includes a password wheel and a shaft, the upper shell is provided with clamping hole matching with the password wheel, the shaft is the foresaid switching member, the password wheel is sleeved on the shaft, the shaft abuts the middle transmission mechanism at one end, the accommodation space is provided with a resetting member for resetting the shaft; when the password is correct, the shaft can move relative to the password wheel; otherwise the shaft is limited by the password wheel.

Furthermore, the password device also includes a decoding device which includes a decoding wheel, a decoding switch block and a decoding block, the decoding wheel is sleeved on the shaft, the password wheel is sleeved outside the decoding wheel, the shaft is provided with an elastic member at one end for resetting the decoding wheel; a clamping block is arranged in the inner side of the decoding wheel, the shaft is provided with an annular groove matching with the clamping block and a moving groove arranged in the axial direction of the shaft, the decoding block is located at the other end of the shaft, the decoding block includes a through hole matching with the shaft, the decoding block is provided with a first bevel face assisting the former to move relative to one end of the shaft; the decoding switch block is provided with a second bevel face matching with the first bevel face, the decoding switch block is provided with a protrusive pressing column at the top, the upper shell is provided with a decoding hole matching with the pressing column, the pressing column protrudes through the decoding hole; During decoding, the password wheel is located in correct position and drives the decoding wheel to rotate, the clamping block in the inner side of the decoding wheel enters the intersection of the annular groove and moving groove from the annular groove of the shaft, then press the pressing column, the decoding switch block drives the decoding block to move and press the elastic member, the decoding block drives the decoding wheel to move, the clamping block in the inner side of the decoding wheel moves in the moving groove of the shaft; the decoding wheel moves relative to the password wheel, after which the password wheel can rotate relative to the decoding wheel; after decoding, release the pressing column of the decoding switch block, the decoding wheel, decoding block and decoding switch block are all repositioned under the action of the elastic member.

Furthermore, the middle transmission mechanism also includes a lock cylinder sleeve and a pushing part, the lock cylinder device includes a lock cylinder, the lock cylinder sleeve is fixed under the pushing part, the lock cylinder is sleeved inside the lock cylinder sleeve and connected with the rotating block; the shaft is connected with the lock cylinder sleeve fixedly at one end.

Furthermore, each group of locking hooks include at least two locking hooks, each locking hook includes a rotating shaft, a hook portion at one end and a limit portion at the other end; the hook portion is under the inserting hole, the accommodation space is provided with a locking block for controlling the rotation of the hook portion, the locking block is under the locking hook, the locking block is provided with a gap matching with the limit portion, each moving piece is provided with a bevel face for driving a corresponding locking block to move.

Furthermore, the accommodation space is also provided with a pressing block, wherein the pressing block is provided with a projection matching with the rotating shaft and a through hole matching with the limit portion at the top, the pressing block is provided with a guide slot matching with the locking block at the bottom, all the bevel faces of the moving pieces are under the pressing block, the locking block is provided with a butting block matching with the bevel face at the bottom, the moving piece is provided with a buffering space near the side of the bevel face for accommodating the butting block, the elastic member is arranged between the locking block and the pressing block for resetting the locking block.

Furthermore, each moving piece is provided with a motion groove at the end far away from the bevel face, the two connecting portions of the rotating block are inserted into corresponding motion grooves respectively.

Furthermore, each of the two moving pieces is provided with a limit rod, the two limit rods about each other.

Furthermore, the pressing block is provided with a substrate extending outwardly near the side of the decoding switch block, the substrate is under the decoding switch block, which is provided with a guide rod, the substrate is provided with a location hole matching with the guide rod, the guide rod is inserted into the locating hole.

Furthermore, the mechanical composite lock also includes a bottom shell, which is connected with the upper shell fixedly.

The beneficial effects of the present invention are as follows: by arranging the two moving pieces for respectively controlling the two groups of locking hooks, the lock cylinder device and the password device can control the two moving pieces to be in different movement modes, and then the present invention achieves the object that the locking hooks can be opened in different ways: can be opened at one time through the lock cylinder device and can also be sequentially opened through the password device.

EXPLANATION OF SYMBOLS

| | | |
|---|---|---|
| 1-bottom plate | 2-moving piece | 3-rotating block |
| 4-elastic piece | 5-lock cylinder sleeve | 6-pushing part |
| 7-shaft | 8-password wheel | 9-decoding switch block |
| 10-decoding block | 11-torsion spring | 13-locking block |
| 14-elastic member | 15-pressing block | 16-decoding wheel |
| 17-lock cylinder | 18-bottom shell | 201-motion groove |
| 202-connecting portion | 203-bevel face | 204-limit rod |
| 301-connecting column | 401-spring leaf | 701-annular groove |
| 702-moving groove | 901-pressing column | 902-guide rod |
| 101-first bevel face | 102-through hole | 121-rotating shaft |
| 122-hook portion | 123-limit portion | 131-gap |
| 132-butting block | 133-auxiliary bevel face | 151-projection |
| 152-substrate | 153-locating hole | 154-guide slot |
| 161-clamping block | 192-bottom supporting block | 12-locking hook |
| 903-second bevel face | 19-upper shell | 191-inserting hole |
| 205-buffering space | | |

DESCRIPTION OF THE PREFERRED EMBODIMENTS

Figure 1:
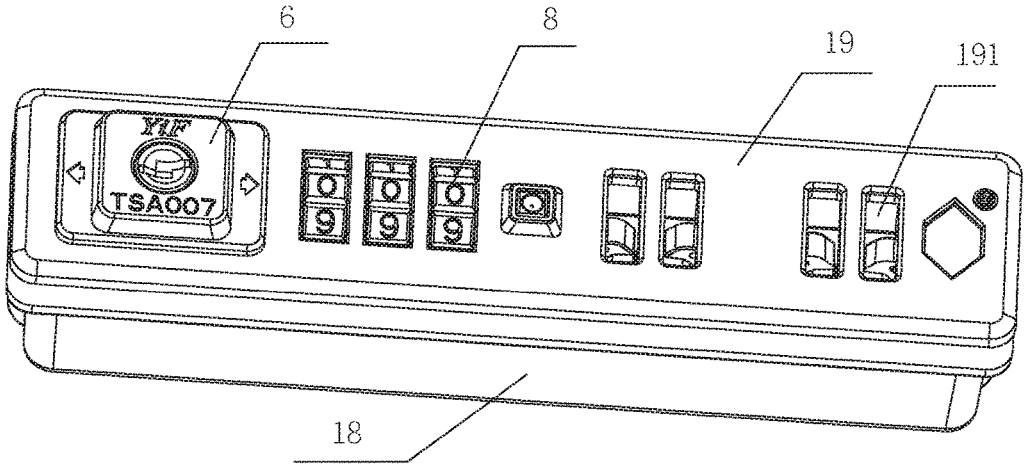
FIG. 1 is a schematic view of present invention.
Figure 2:
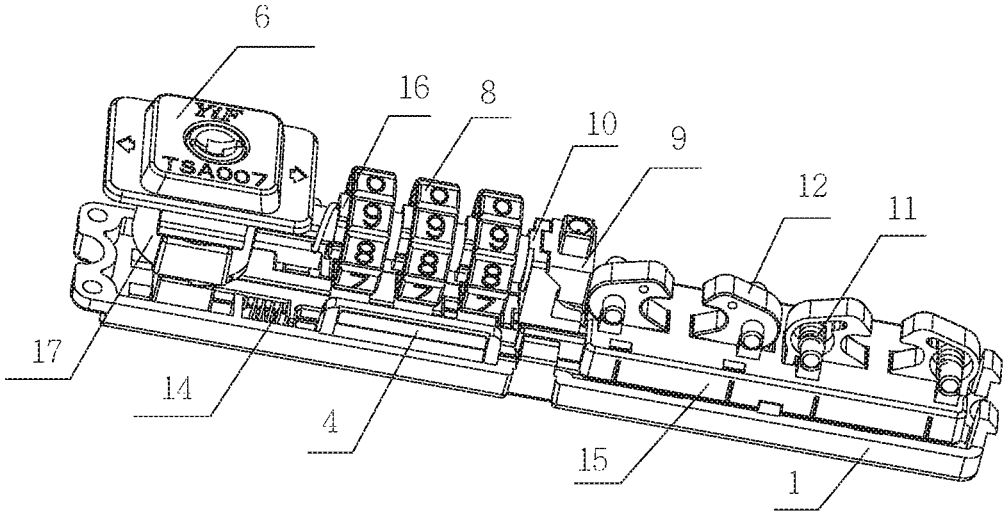
FIG. 2 is a schematic view of FIG. 1 apart from the upper shell and bottom shell.
Figure 3:
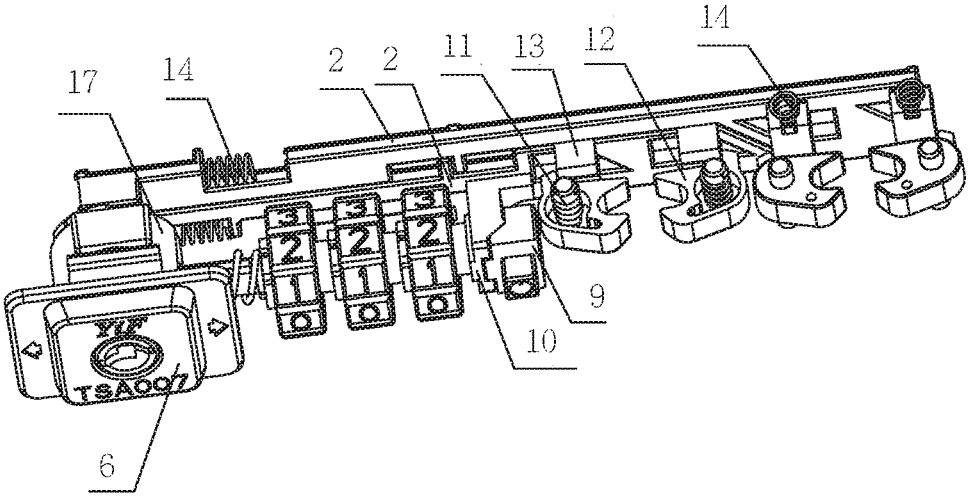
FIG. 3 is a schematic view of FIG. 2 apart from the pressing block from another perspective.
Figure 4:
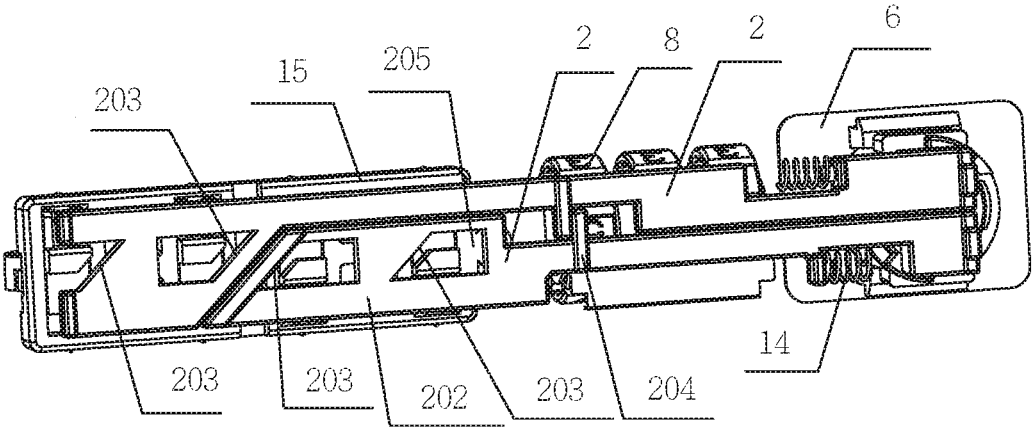
FIG. 4 is a schematic view of FIG. 2 from another perspective.
Figure 5:
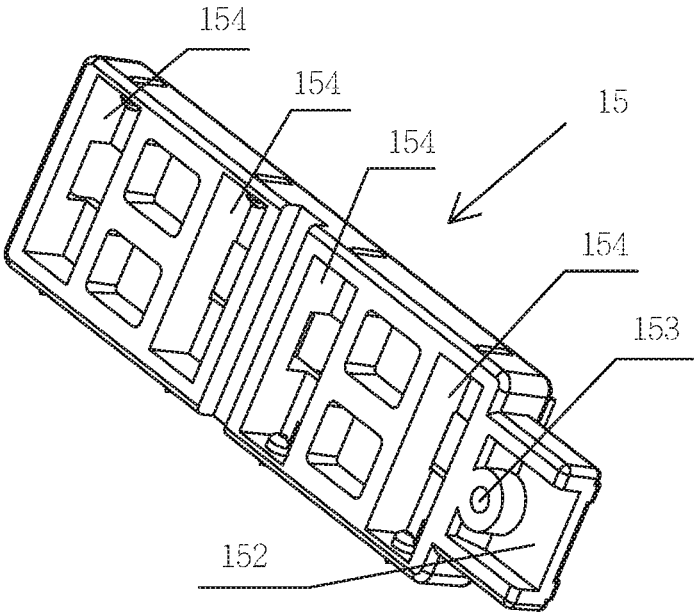
FIG. 5 is a schematic view of the pressing block according to present invention.
Figure 6:
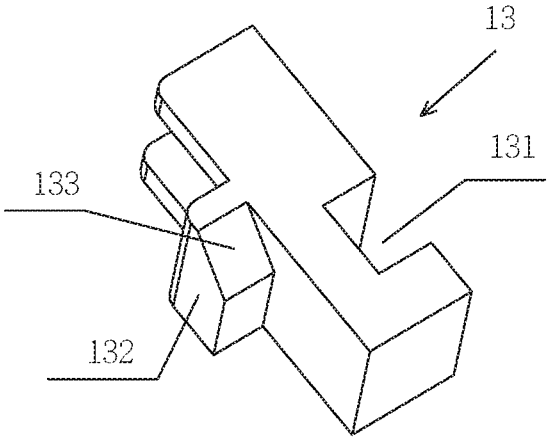
FIG. 6 is a schematic view of the locking block according to present invention.
Figure 7:
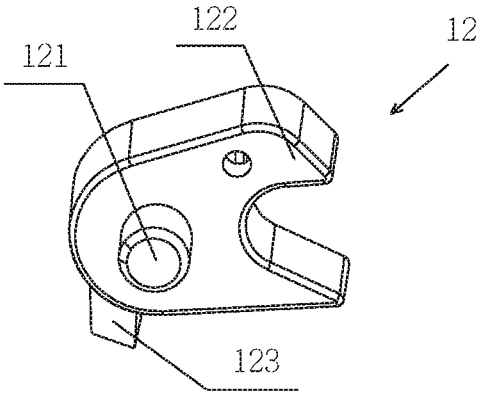
FIG. 7 is a schematic view of a locking hook according to present invention.
Figure 8:
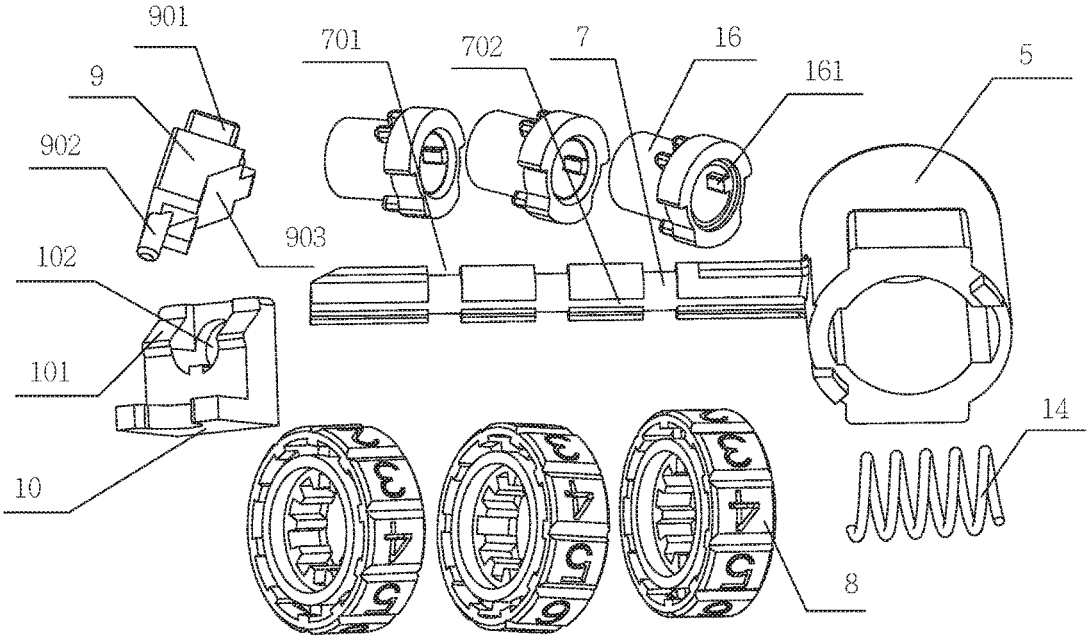
FIG. 8 is an exploded view of the password device and lock cylinder device according to present invention.
Figure 9:
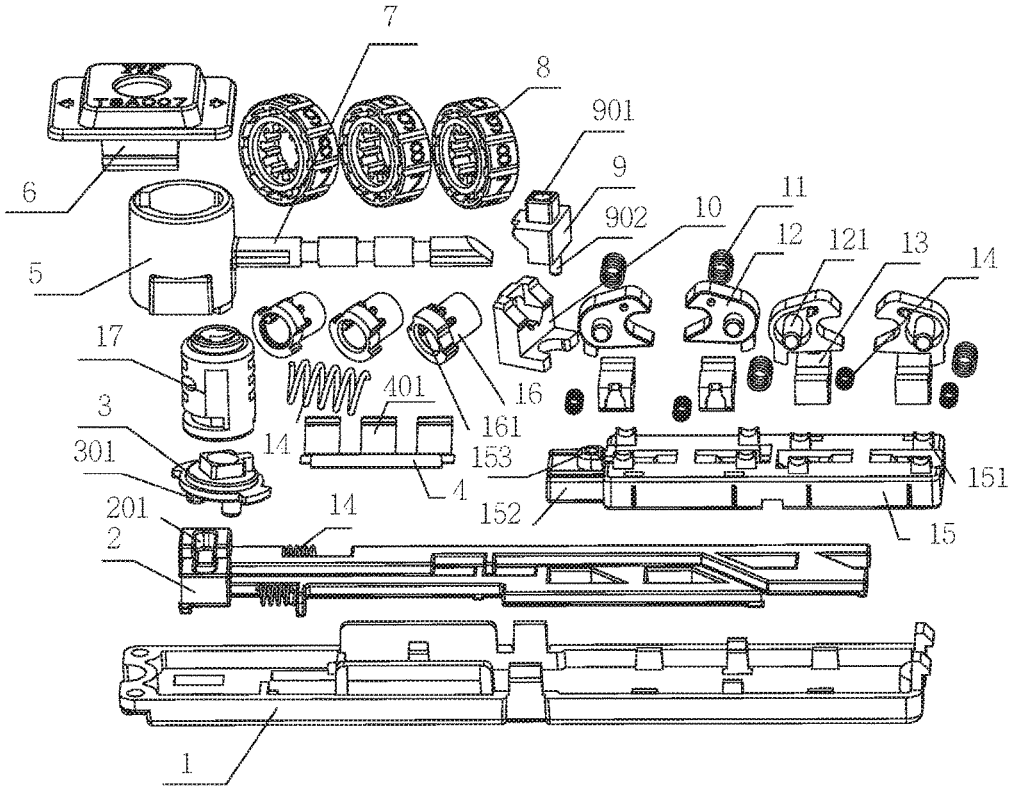
FIG. 9 is an exploded view of FIG. 2.
Figure 10:
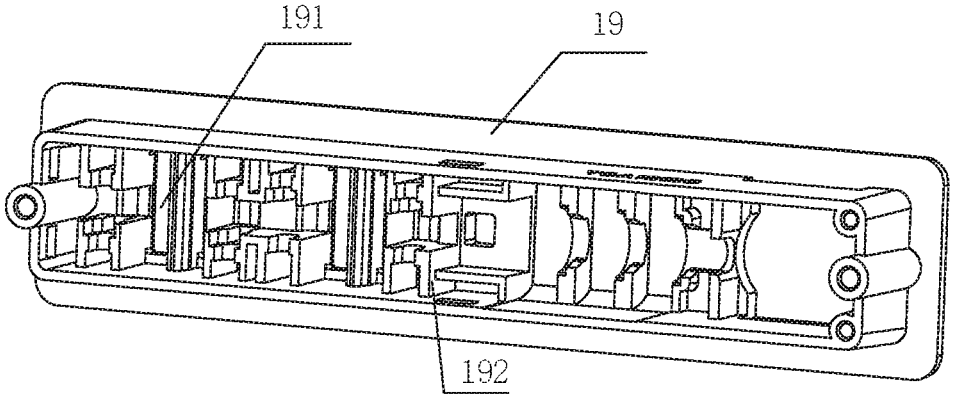
FIG. 10 is a schematic view of the upper shell according to present invention.

Work Example: Refer to FIG. 1 to FIG. 10

A mechanical composite lock which includes a bottom plate 1 and an upper shell 19, wherein the both are connected with each other fixedly and an accommodation space is formed between them; the accommodation space is provided with two groups of locking hooks at one end; an inserting hole 191 matching with a locking hook is formed in the upper shell 19; two moving pieces 2 for controlling the two groups of locking hooks are arranged in the accommodation space as first moving piece and second moving piece; the opening directions of the two groups of locking hooks are opposite to each other; the accommodation space is provided with a middle transmission mechanism, a lock cylinder device and a password device at the other end, the middle transmission mechanism is connected with the first moving piece and the second moving piece respectively; the accommodation space is provided with a moving space for moving the middle transmission mechanism; the lock cylinder device and the password device are respectively connected with the middle transmission mechanism; when the lock is opened through a password, the middle transmission mechanism can move relative to the accommodation space and drive the first moving piece and second moving piece to move in the same direction, and then one group of locking hooks are opened; when the lock is opened through the lock cylinder device, the first moving piece and second moving piece are driven to move in opposite directions, and then the two groups of locking hooks are opened.

In the present invention, the movement of the two groups of locking hooks are controlled through the middle transmission mechanism, by which the locking hooks can be opened in different ways, and then the two groups of locking hooks can be opened uniformly through a key during the transit checking or can be opened respectively through the movement of the middle transmission mechanism toward different directions during use, that is: a corresponding group of locking hooks can be sequentially opened when the middle transmission mechanism moves leftward or rightward, which is convenient for use. In order to reset the two moving pieces 2 conveniently, for example, when the lock is opened through a password, when a moving piece is driven to open a group of locking hooks, the moving pieces can reposition, therefore, an elastic member 14 is arranged in the accommodation apace for resetting the two moving pieces 2.

During the specific settings, the two moving pieces 2 are provided with a buffering space 205 and a connecting portion 202 matching with a locking hook 12 respectively, the connecting portions 202 are located at different sides of a corresponding buffering space 205, for example, the connecting portion 202 of the first moving piece is located at the left side of a corresponding buffering space 205, the connecting portion 202 of the second moving piece is located at the right side of a corresponding buffering space 205. When the lock is opened through a password, the middle transmission mechanism drives the two moving pieces 2 to move in the same direction, by which just one group of locking hooks can be opened at one time. When the lock is opened through a key, the middle transmission mechanism drives the two moving pieces 2 to move in opposite directions, by which the two groups of locking hooks can be opened simultaneously.

Furthermore, the middle transmission mechanism includes a rotating block 3, the rotating block 3 is provided with two connecting portions, which are respectively connected with the two moving pieces 2; the rotating block 3 is connected with the lock cylinder device, wherein the lock cylinder device can drive the rotating block 3 to rotate.

By arranging the rotating block 3 for controlling the movement of the two moving pieces, when the lock is opened through a password, the rotating block 3 moves together with the middle transmission mechanism, and the two moving pieces 2 are driven to move in the same direction through the two connecting portions, by which a single group of locking hooks can be opened. When the lock is opened through the lock cylinder device, the rotating block 3 rotates, by which the moving pieces 2 are driven to move in opposite directions, and the two groups of locking hooks can be opened simultaneously.

Furthermore, the password device is provided with a switching member for controlling the movement of the middle transmission mechanism, when the lock is locked through a password, the switching member is located in locking position limiting the movement of the middle transmission mechanism; when the lock is opened through a password, the switching member is located in unlocking position permitting the movement of the middle transmission.

There is a switching member arranged in a present coded lock for controlling the switch, for example, the password device includes a password wheel 8 and a locking piece, wherein the position of the locking piece is controlled through the password wheel 8, herein the locking piece is the switching member.

Furthermore, the password device includes a password wheel 8 and a shaft 7, the upper shell 19 is provided with clamping hole matching with the password wheel 8, the shaft 7 is the foresaid switching member, the password wheel 8 is sleeved on the shaft 7, the shaft 7 abuts the middle transmission mechanism at one end, the accommodation space is provided with a resetting member for resetting the shaft 7; when the password is correct, the shaft 7 can move relative to the password wheel 8; otherwise the shaft 7 is limited by the password wheel 8.

Use the shaft 7 as the switching member for cutting down the cost and reducing the number of working parts. In order to rotate the password wheel 8 more smoothly, an elastic piece 4 is arranged in the accommodation space, the elastic piece 4 includes a spring leaf 401 matching with the password wheel 8, the elastic piece 4 is fixed under the bottom plate 1, the spring leaf 401 is connected with the password wheel 8.

Furthermore, the password device also includes a decoding device which includes a decoding wheel 16, a decoding switch block 9 and a decoding block 10, the decoding wheel 16 is sleeved on the shaft 7, the password wheel 8 is sleeved outside the decoding wheel 16, the shaft 7 is provided with an elastic member 14 at one end for resetting the decoding wheel 16; a clamping block 161 is arranged in the inner side of the decoding wheel 16, the shaft 7 is provided with an annular groove 701 matching with the clamping block 161 and a moving groove 702 arranged in the axial direction of the shaft 7, the decoding block 10 is located at the other end of the shaft 7, the decoding block 10 includes a through hole 102 matching with the shaft 7, the decoding block 10 is provided with a first bevel face 101 assisting the former to move relative to one end of the shaft 7; the decoding switch block 9 is provided with a second bevel face 903 matching with the first bevel face 101, the decoding switch block 9 is provided with a protrusive pressing column 901 at the top, the upper shell 19 is provided with a decoding hole matching with the pressing column 901, the pressing column 901 protrudes through the decoding hole; During decoding, the password wheel 8 is located in correct position and drives the decoding wheel 16 to rotate, the clamping block 161 in the inner side of the decoding wheel 16 enters the intersection of the annular groove 701 and moving groove 702 from the annular groove 701 of the shaft 7, then press the pressing column 901, the decoding switch block 9 drives the decoding block 10 to move and press the elastic member 14, the decoding block 10 drives the decoding wheel 16 to move, the clamping block 161 in the inner side of the decoding wheel 16 moves in the moving groove 702 of the shaft 7; the decoding wheel 16 moves relative to the password wheel 8, after which the password wheel 8 can rotate relative to the decoding wheel 16; after decoding, release the pressing column 901 of the decoding switch block 9, the decoding wheel 16, decoding block 10 and decoding switch block 9 are all repositioned under the action of the elastic member 14.

By arranging the decoding device, the password device can be decoded conveniently, the password can be changed regularly, and then the security is improved.

Furthermore, the middle transmission mechanism also includes a lock cylinder sleeve 5 and a pushing part 6, the lock cylinder device includes a lock cylinder 17, the lock cylinder sleeve 5 is fixed under the pushing part 6, the lock cylinder 17 is sleeved inside the lock cylinder sleeve 5 and connected with the rotating block 3; the shaft 7 is connected with the lock cylinder sleeve 5 fixedly at one end.

In the present invention, the shaft 7 and the lock cylinder sleeve 7 can be molded integrally. And then the foresaid resetting member for resetting the shaft and the resetting member for decoding are integrated, a spring is sleeved at one end of the shaft 7. During designing, the upper shell 19 is provided with a through hole matching with the pushing part 6, the top of the pushing part 6 protrudes through the upper shell 19, when the lock is opened through a password, the pushing part 6 is pushed to move, pushing part 6 and the lock cylinder sleeve 5 drive the shaft 7 to move, and the lock cylinder 17 drives the rotating block 3 and the two moving pieces 2 to move at the same time, as the spring is pressed between the lock cylinder sleeve 5 and the decoding wheel 16 (or the password wheel 8), the decoding wheel 16 is limited through the password wheel 8, the spring is compressed; when the lock is opened, release the pushing part, the shaft 7, lock cylinder sleeve 5 etc. are all repositioned under the thrust of the spring. During decoding, when the password is correct, the decoding block 10 drives the decoding wheel 16 to move relative to the shaft 7, the decoding wheel 16 extrudes the spring; After decoding, the decoding wheel 16 is repositioned through the spring.

Furthermore, each group of locking hooks include at least two locking hooks 12, each locking hook 12 includes a rotating shaft 121, a hook portion 122 at one end and a limit portion 123 at the other end; the hook portion 122 is under the inserting hole 191, the accommodation space is provided with a locking block 13 for controlling the rotation of the hook portion 122, the locking block 13 is under the locking hook 12, the locking block 13 is provided with a gap 131 matching with the limit portion 123, each moving piece 2 is provided with a bevel face 203 for driving a corresponding locking block 13 to move.

The rotating shaft 121 can be fixed on the flank of the upper shell 19 during the settings of the locking hook 12, for example, a shaft hole is arranged in flank, the locking hook 12 is articulated with the upper shell 19; Of course the locking hook 12 can be arranged in other locations, for example, a supporting column is arranged on the bottom plate 1, the supporting column is provided with a shaft hole, the locking hook 12 is articulated with the supporting column; when the locking hook 12 is preliminary fixed, the locking block 13 is moved through the moving pieces 12, and then the rotation of the locking hooks 12 is in control; when open the lock, the hook portion 122 corresponds with the gap 131, the locking hooks 12 can be rotated, and then the lock is opened; when lock the lock, the locking block 13 is moved through the moving pieces 2, by which the dislocation occurs between the hook portion 122 and the gap 131, the locking hooks 12 can't be rotated, and then the lock is locked. When the locking block 13 is moved through the moving pieces 2, in order to ensure that the direction of the movement of the locking block 13 and the direction of the moving pieces 2 are perpendicular to each other, the locking block 13 is moved through the bevel face 203. In order to open the locking hooks 12 conveniently, the torsion spring 11 is sleeved on the rotating shaft 121 of the locking hooks 12 for resetting the locking hooks 12, when the locking block 13 is moved to unlocking position through the moving pieces 12, the corresponding locking hooks 12 are rotated to opening position through the torsion spring 11.

Furthermore, the accommodation space is also provided with a pressing block 15, wherein the pressing block 15 is provided with a projection 151 matching with the rotating shaft 121 and a through hole matching with the limit portion 123 at the top, the pressing block 15 is provided with a guide slot 154 matching with the locking block 13 at the bottom, all the bevel faces 203 of the moving pieces 2 are under the pressing block 15, the locking block 13 is provided with a butting block 132 matching with the bevel face 203 at the bottom, the moving piece 2 is provided with a buffering space 205 near the side of a bevel face 203 for accommodating the butting block 132, the elastic member 14 is arranged between the locking block 13 and the pressing block 15 for resetting the locking block 13.

The locking hooks 12 are set conveniently after providing the pressing block 15, the locking block 13 can match with the locking hooks 12 smoothly after providing the elastic member 14; when open the lock, the locking block 13 is moved through the bevel face 203 of a moving piece 2; when lock the lock, the locking block 13 are repositioned through the elastic member 14. In order to move the locking block 13 smoothly, the pressing block 15 is provided with a guide slot 154, the locking block 13 moves in the guide slot 154. In order to fix the rotating shaft 121 on the projection 151, the upper shell 19 is provided with a bottom supporting block 192 matching with the projection 151, a shaft hole matching with the rotating shaft 121 is formed between the bottom supporting block 192 and the projection 151. In order to match a butting block 132 with a bevel face 203, the butting block 132 is provided with an auxiliary bevel face 133 matching with a bevel face 203.

Furthermore, each moving piece 2 is provided with a motion groove 201 at the end far away from a bevel face 203, the two connecting portions of the rotating block 3 are inserted into corresponding motion grooves 201 respectively.

In practical application, the connecting portion is the connecting column 301, the top of the connecting column 301 is connected with the rotating block 3 fixedly, the bottom of the connecting column 301 is inserted into the motion groove 201.

Furthermore, each of the two moving pieces 2 is provided with a limit rod 204, the two limit rods 204 abut each other.

The two limit rods 204 are provided for preventing a wrong direction of the rotation when opening the lock through a key. If the direction of the rotation is wrong, the two limit rods 204 move relative to each other and abut, then the rotation of the lock cylinder 17 is limited. Only if the direction of the rotation is correct, the two limit rods 204 move in opposite directions, by which the two moving pieces 2 are moved.

Furthermore, the pressing block 15 is provided with a substrate 152 extending outwardly near the side of the decoding switch block 9, the substrate 152 is under the decoding switch block 9, which is provided with a guide rod 902, the substrate 152 is provided with a location hole 153 matching with the guide rod 902, the guide rod 902 is inserted into the locating hole 153.

When decode the lock, the decoding switch block 9 can move relative to the decoding block 10, the guide pole and the locating hole 153 are provided for preventing the deviation of the decoding switch block 9. And then the decoding switch block 9 can be moved directionally.

Furthermore, the mechanical composite lock also includes a bottom shell 18, the bottom shell 18 is connected with the upper shell fixedly. The bottom shell 18 is provided for hiding the password device, lock cylinder device, the locking hooks 12 and so on.

What is claimed is:

1. A mechanical composite lock which includes a bottom plate and an upper shell, wherein the both are connected with each other fixedly and an accommodation space is formed between them; the accommodation space is provided with two groups of locking hooks at one end; an inserting hole matching with a locking hook is formed in the upper shell; the lock is characterized in that: two moving pieces for controlling the two groups of locking hooks are arranged in the accommodation space as first moving piece and second moving piece; the opening directions of the two groups of locking hooks are opposite to each other; the accommodation space is provided with a middle transmission mechanism, a lock cylinder device and a password device at the other end, the middle transmission mechanism is connected with the first moving piece and the second moving piece respectively; the accommodation space is provided with a moving space for moving the middle transmission mechanism; the lock cylinder device and the password device are respectively connected with the middle transmission mechanism; when the lock is opened through a password, the middle transmission mechanism can move relative to the accommodation space and drive the first moving piece and second moving piece to move in the same direction, and then one group of locking hooks are opened; when the lock is opened through the lock cylinder device, the first moving piece and second moving piece are driven to move in opposite directions, and then the two groups of locking hooks are opened.

2. A mechanical composite lock according to claim 1, which is characterized in that: the middle transmission mechanism includes a rotating block, the rotating block is provided with two connecting portions, which are respectively connected with the two moving pieces; the rotating block is connected with the lock cylinder device, wherein the lock cylinder device can drive the rotating block to rotate.

3. A mechanical composite lock according to claim 2, which is characterized in that: the password device is provided with a switching member for controlling the movement of the middle transmission mechanism, when the lock is locked through a password, the switching member is located in locking position limiting the movement of the middle transmission mechanism; when the lock is opened through a password, the switching member is located in unlocking position permitting the movement of the middle transmission.

4. A mechanical composite lock according to claim 3, which is characterized in that: the password device includes a password wheel and a shaft, the upper shell is provided with clamping hole matching with the password wheel, the shaft is the foresaid switching member, the password wheel is sleeved on the shaft, the shaft abuts the middle transmission mechanism at one end, the accommodation space is provided with a resetting member for resetting the shaft; when the password is correct, the shaft can move relative to the password wheel; otherwise the shaft is limited by the password wheel.

5. A mechanical composite lock according to claim 4, which is characterized in that: the password device also includes a decoding device which includes a decoding wheel, a decoding switch block and a decoding block, the decoding wheel is sleeved on the shaft, the password wheel is sleeved outside the decoding wheel, the shaft is provided with an elastic member at one end for resetting the decoding wheel; a clamping block is arranged in the inner side of the decoding wheel, the shaft is provided with an annular groove matching with the clamping block and a moving groove arranged in the axial direction of the shaft, the decoding block is located at the other end of the shaft, the decoding block includes a through hole matching with the shaft, the decoding block is provided with a first bevel face assisting the former to move relative to one end of the shaft; the decoding switch block is provided with a second bevel face matching with the first bevel face, the decoding switch block is provided with a protrusive pressing column at the top, the upper shell is provided with a decoding hole matching with the pressing column, the pressing column protrudes through the decoding hole; during decoding, the password wheel is located in correct position and drives the decoding wheel to rotate, the clamping block in the inner side of the decoding wheel enters the intersection of the annular groove and moving groove from the annular groove of the shaft, then press the pressing column, the decoding switch block drives the decoding block to move and press the elastic member, the decoding block drives the decoding wheel to move, the clamping block in the inner side of the decoding wheel moves in the moving groove of the shaft; the decoding wheel moves relative to the password wheel, after which the password wheel can rotate relative to the decoding wheel; after decoding, release the pressing column of the decoding switch block, the decoding wheel, decoding block and decoding switch block are all repositioned under the action of the elastic member.

6. A mechanical composite lock according to claim 4, which is characterized in that: the middle transmission mechanism also includes a lock cylinder sleeve and a pushing part, the lock cylinder device includes a lock cylinder, the lock cylinder sleeve is fixed under the pushing part, the lock cylinder is sleeved inside the lock cylinder sleeve and connected with the rotating block; the shaft is connected with the lock cylinder sleeve fixedly at one end.

7. A mechanical composite lock according to anyone of claim 1-6, which is characterized in that: each group of locking hooks include at least two locking hooks, each locking hook includes a rotating shaft, a hook portion at one end and a limit portion at the other end; the hook portion is under the inserting hole, the accommodation space is provided with a locking block for controlling the rotation of the hook portion, the locking block is under the locking hook, the locking block is provided with a gap matching with the limit portion, each moving piece is provided with a bevel face for driving a corresponding locking block to move.

8. A mechanical composite lock according to claim 7, which is characterized in that: the accommodation space is also provided with a pressing block, wherein the pressing block is provided with a projection matching with the rotating shaft and a through hole matching with the limit portion at the top, the pressing block is provided with a guide slot matching with the locking block at the bottom, all the bevel faces of the moving pieces are under the pressing block, the locking block is provided with a butting block matching with the bevel face at the bottom, the moving piece is provided with a buffering space near the side of the bevel face for accommodating the butting block, the elastic member is arranged between the locking block and the pressing block for resetting the locking block.

9. A mechanical composite lock according to claim 7, which is characterized in that: each moving piece is provided with a motion groove at the end far away from the bevel face, the two connecting portions of the rotating block are inserted into corresponding motion grooves respectively.

10. A mechanical composite lock according to claim 1, which is characterized in that: each of the two moving pieces is provided with a limit rod, the two limit rods about each other.

* * * * *